United States Patent [19]

Newton

[11] 3,954,030

[45] May 4, 1976

[54] FULCRUM TYPE CAN OPENER

[75] Inventor: Albert E. Newton, Beverly, Mass.

[73] Assignee: USM Corporation, Boston, Mass.

[22] Filed: Aug. 26, 1975

[21] Appl. No.: 607,881

[52] U.S. Cl. ..... 81/3.46 R

[51] Int. Cl.[2] ..... B67B 7/00

[58] Field of Search ..... 81/3.46 R, 3.46 A, 3.34, 81/3.4

[56] References Cited

UNITED STATES PATENTS 3,290,967 12/1966 Stark ..... 81/3.46 R

*Primary Examiner*—Al Lawrence Smith
*Assistant Examiner*—Roscoe V. Parker
*Attorney, Agent, or Firm*—Carl E. Johnson; Vincent A. White; Richard B. Megley

[57] ABSTRACT

A hand-held, one-piece tool of single stamping design is adapted to be fulcrumed on the chime or rim of a container having an end closure, especially a closure defined by a weakening line. Relative upward pivotal operating movement of a handle portion about a first fulcrum portion acting on an outside wall of the container concentrates initial opening by a cam end portion of the tool bearing on the closure adjacent to its weakening line, and further movement of the handle shifts its fulcrum to a second fulcrum portion of the tool acting on the closure rim whereby the cam end portion bears progressively on the closure and away from its rim to rupture the weakening line and easily deflect the closure relatively inwardly of the container.

3 Claims, 5 Drawing Figures

FULCRUM TYPE CAN OPENER

BACKGROUND OF THE INVENTION

This invention relates to fulcrum type can openers, and especially those of hand-held, inexpensive design.

Many can ends of sheet metal, even those including closures defined by weakening lines, may at times not be conveniently openable by direct manual tension or pressure. This may be the case when numerous cans are to be successively opened for rapidly dispensing liquid contents, and the strength or dexterity of some persons might be taxed without the aid of a suitable tool. As is well known certain closures are opened by means of lifting tabs and others are simply manually depressed by finger pressure applied at the locality where rupture is to be initiated. The latter may be exemplified by a closure of the general type disclosed in U.S. Pat. No. 3,881,630, issued May 6, 1975 in the names of Walter C. Lovell et al.

It is known to provide a lever type can opener which may be fulcrumed on a can rim to cause a pointed extremity of the lever and adjacent V-shaped cutting edges to shear the end metal from an inner point toward the outer rim. End closures defined by weakening lines, however, commonly require the progressive opening to proceed radially from a locality adjacent to the rim and toward a more inward hinged locality to facilitate neat pouring and more complete emptying of the contents.

SUMMARY OF THE INVENTION

In view of the foregoing it is an object of this invention to provide an improved manually operable fulcrum type opener for operating on containers, especially cans of the type having rupturable sheet metal end closures adapted to be depressed and movable inwardly thereof.

More specifically it is an object of this invention to provide a simple opener, a single operating stroke of which will progressively deflect along a tear line a can end closure inwardly from a locality adjacent the can rim to an inner hinge locality.

To these ends, and as herein shown, a hand tool, preferably in the form of a stiff, straight metal lever, has a handle portion and an operating end portion, the latter including a rounded cam shaped extremity for progressively bearing on the end closure of a can to be opened, and a pair of fulcra intermediate the handle portion and the cam shaped extremity, one of the fulcra being adapted initially to bear on the exterior of the rim of the can and the other fulcrum being arranged to bear thereafter on an interior rim portion of the end closure as the tool is pivoted through an operating stroke to cause the cam shaped extremity to deflect the end closure inwardly and away from the can exterior. Desirably, the tool may be of flat stock which may be inexpensively stamped from a blank and its fulcra thus formed simultaneously with the cam portion.

BRIEF DESCRIPTION OF THE DRAWINGS

The foregoing and other features of the invention will now be more particularly described in connection with an illustrative embodiment, and with reference to the accompanying drawings thereof, in which.

DESCRIPTION OF PREFERRED EMBODIMENT

Figure 1:
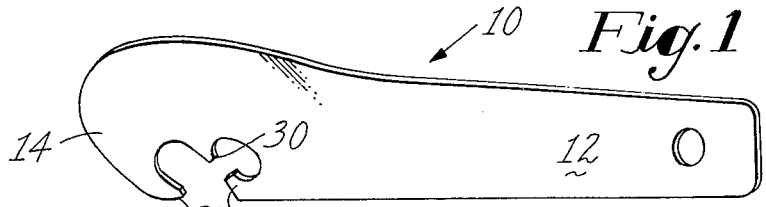
FIG. 1 is a perspective view of a can opener.

A can opener generally designated 10 in the drawings is preferably a flat, stiff blank which may be die cut from sheet stock to provide a lever having a hand grip portion 12 and, at one end, a rounded cam portion 14 for relatively defelecting inwardly a closure 16 defined by a weakening line 18 in a can top 20. The latter is usually of sheet metal. The closure 16 to be opened may be of different configuration than circular but will normally be at least partly defined by the weakening line 18 extending from a locality 22 adjacent to an outer rim 24 of the can end to a more radially inward or hinging locality 25 of the closure.

Figure 2:
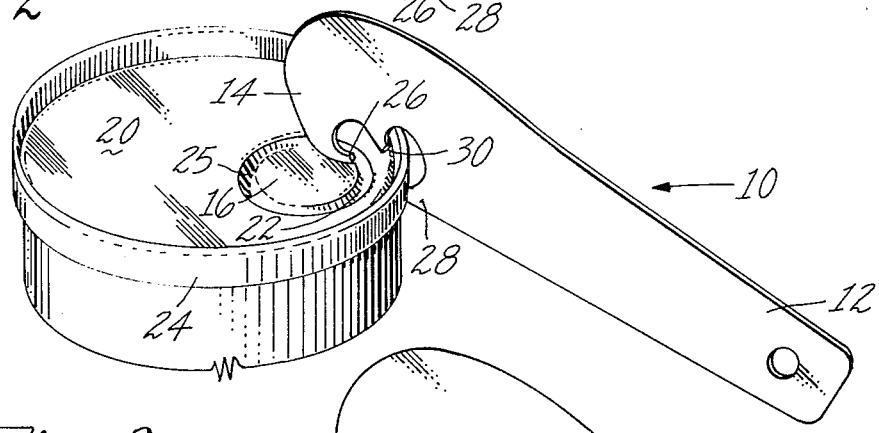
FIG. 2 is a perspective view of the opener of FIG. 1 as initially applied to a can end rim, the can having a rupturable end closure to be opened.
Figure 3:
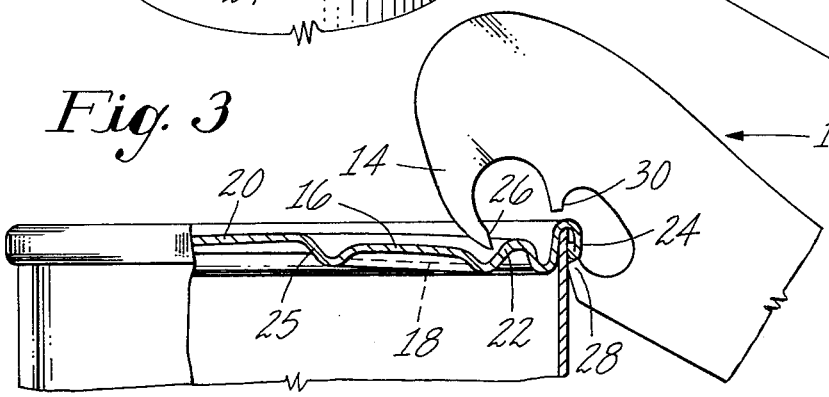
FIG. 3 is a section showing the representative can end of FIG. 2, and indicating on a larger scale the operating end of the opener as first applied.
Figure 4:
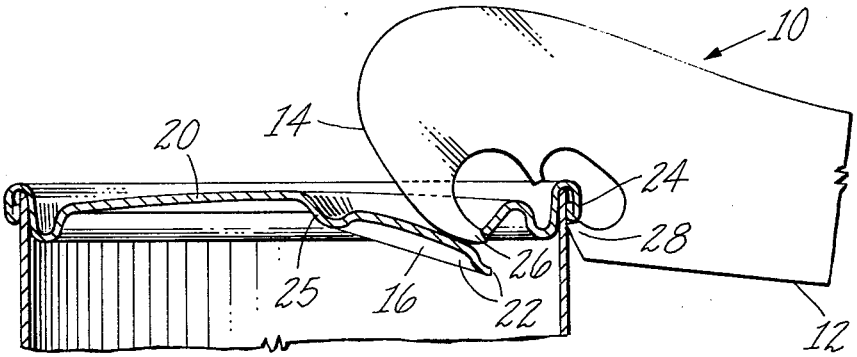
FIGS. 4 & 5 are views similar to FIG. 3 but showing the opener at successive can opening stages.
Figure 5:
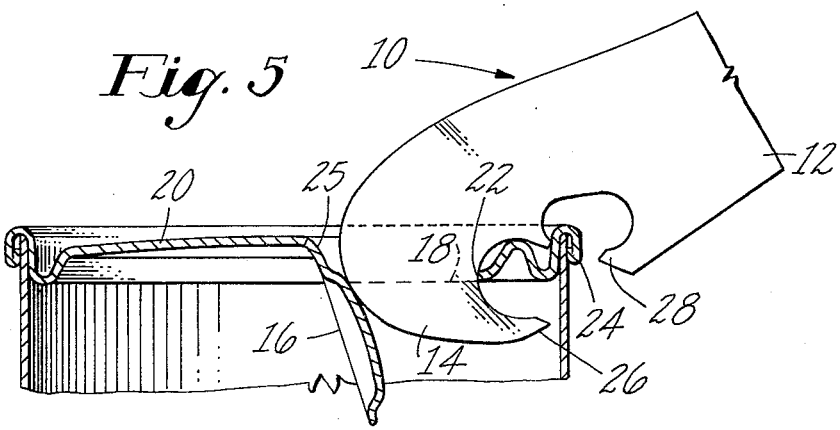

When the opener 10 is first applied as shown in FIGS. 2, 3, a projecting end 26 of the cam portion 14 is adapted to bear, downwardly on the locality 22 as the handle 12 is moved counter-clockwise with a fulcrum projection 28 engaging the outer rim 24 of the can end or an exterior portion of the can wall. The pressure thus exerted by the end 26 and concentrated close to the weakening line at the locality 22 effectively ruptures the closure as shown in FIG. 4. Continued counter-clockwise operating movement of the handle 12 next causes a second fulcrum projection 30, disposed between the first or exterior fulcrum 28 and the cam end 26, to pivotally engage an interior rim portion of the can end as illustrated in FIG. 5. The cam 14 is accordingly enabled to progressively engage the closure 16 from a radially outer to a radially inner point as the closure is deflected relatively downwardly into the can and the weakening line 18 is ruptured along its length sufficiently to allow can contents to be poured.

Some variation in the shapes of the cam 14 and of the fulcra projections 28, 30, as well as their selected spacing along an edge and in the general plane of the lever 10, may be desired for different and particular shapes of closures and can chimes or rims. Usually tips of the projections 26, 28, 30 will be interconnected by arcuate cut out portions defining a cursive capital E. In general, however, the invention enables the opener 10 to be inexpensively made and effectively operable on containers having different weakening line configurations 18. The shifting of fulcra from an external point on the can to the internal rim portion occurs in each operating stroke of the opener, and without any chance of injury to a hand actuating the lever.

Having thus described my invention, what I claim as new and desire to secure as Letters Patent of the United States is:

1. A can opener of the manually pivotal type comprising a flat lever having a handle portion and a rounded cam shaped extremity, said extemity being adapted to bear progressively inwardly radially on a closure of a can end to be opened, the lever having intermediate the handle portion and the cam extremity a pair of fulcrum portions one of which is disposed to bear pivotally on an exterior rim of the can, and the other of which is disposed thereafter to bear pivotally on an interior rim portion of the closure, whereby the closure is deflected away from the can exterior and about an inner hinge locality.

2. A can opener as in claim 1 wherein the fulcrum portions lie along an edge portion of the lever and substantially in a plane with the cam shaped extremity.

3. A can opener as in claim 1 wherein the lever is die cut from sheet stock and has its cam extremity and fulcrum portions interconnected by arcs defining a cursive capital E.

* * * * *